United States Patent [19]

Traut

[11] Patent Number: 4,985,069

[45] Date of Patent: Jan. 15, 1991

[54] INDUCTION SLAG REDUCTION PROCESS FOR MAKING TITANIUM

[75] Inventor: Davis E. Traut, Corvallis, Oreg.

[73] Assignee: The United States of America as represented by the Secretary of the Interior, Washington, D.C.

[21] Appl. No.: 907,341

[22] Filed: Sep. 15, 1986

[51] Int. Cl.[5] ..... C22B 34/00

[52] U.S. Cl. ..... 75/10.18; 75/612

[58] Field of Search ..... 75/1 T, 10.18, 84

[56] References Cited

U.S. PATENT DOCUMENTS

| | | | |
|---|---|---|---|
| 3,101,267 | 8/1963 | Dunn | 75/10.18 |
| 3,472,648 | 10/1969 | Suriani | 75/1 T |
| 3,493,363 | 2/1970 | Ahearn | 75/10.18 |
| 3,679,394 | 7/1972 | Buehler | 75/10.18 |

*Primary Examiner*—Peter D. Rosenberg

*Attorney, Agent, or Firm*—E. Philip Koltos

[57] ABSTRACT

Continuous process for preparing titanium comprising fluorinating titanium ore, and reducing the formed alkaline earth fluotitanate with an alkaline earth metal in an induction slag reactor.

11 Claims, 3 Drawing Sheets

INDUCTION SLAG REDUCTION PROCESS FOR MAKING TITANIUM

FIELD OF THE INVENTION

The invention pertains to the preparation of titanium metal and alloys from titanium ores utilizing the steps of fluorinating the ores to convert the titanium values to alkaline earth titanium fluorides and reducing the alkaline earth titanium fluorides to titanium metal. The reduction is continuously carried out by contacting the alkaline earth titanium fluorides with an alkaline earth reductant in an induction slag melting crucible at conditions where the reactants, titanium, alloying elements and byproducts are molten. Titanium or titanium alloy and the byproducts are continuously withdrawn from the melting furnace in a cooled solid state and the titanium or alloy can be physically separated from the byproduct materials.

The titanium ore may be an ilmenite ore and the fluorinating step can be carried out by contacting said ilmenite ore with either hydrofluoric acid or a fluosilicate salt such as calcium fluosilicate. The reductant is an alkaline earth metal such as calcium or magnesium, or an alkali metal such as sodium or potassium.

BACKGROUND OF THE INVENTION

Titanium is a light weight, noncorrosive, high strength-to-weight metal that is extensively used in the aircraft industry, and, more recently, in the chemical process industry and energy related fields.

Currently, titanium is made by the Kroll Process, which is disclosed in U.S. Pat. No. 2,205,854. While the Kroll process uses magnesium in the reduction step, it is also known to use sodium reduction, as set forth by Hunter in *Metallic Titanium,* (J. Am. Chem. Soc., v. 32, 1910 p. 330.).

Kroll and Hunter use rutile, a rutile substitute or upgraded ilmenite as the raw material. In these processes, the raw materials are chlorinated to produce titanium tetrachloride and other impurity chlorides, followed by distillation, wherein the titanium tetrachloride is separated from the other chlorides, and then reduced by magnesium or sodium, to produce titanium sponge. This sponge is purified by vacuum distillation, helium sweep or leaching, and then pressed into electrodes which are arc melted up to three times to consolidate and purify the titanium while blending in alloying elements. In general, the disadvantages of the Kroll and Hunter processes include non-continuous operation, numerous processing steps, and high energy consumption.

Some early attempts to provide processes for producing titanium that are continuous, less costly, and utilize fewer and simpler steps involved the use of fluoride salts as titanium extraction agents for oxide ores, such as ilmenite. These are disclosed in U.S. Pat. Nos. 2,418,073; 2,418,074; 2,653,855; 2,813,068; 2,823,991 and 2,837,426.

Despite the innovative use of fluoride salts in the aforementioned patents, there was still the need in the industry to provide a simpler, more direct route to titanium metal, which used chemical reduction of the fluotitanate salts directly to titanium metal.

U.S. Pat. No. 4,390,365 which is incorporated wherein by reference attempts to achieve this, and discloses a process for converting a titanium oxide ore, such as ilmenite into titanium by fluorinating titanium oxide, reducing the formed titanium fluoride to titanium metal by contacting the titanium fluoride with a molten alloy of zinc and aluminum, recovering the titanium-zinc alloy from the aluminum fluoride residue, removing the zinc from the alloy by distillation, and leaving titanium metal. However, in the removal of zinc, there is risk of residual zinc contamination. Moreover, the process is noncontinuous and the production of substantial amounts of environmentally hazardous aluminum fluoride compounds are readily apparent disadvantages of this process.

Titanium and its alloys are reactive metals as temperatures above about 650° C., have high melting points, and, when molten, react with most materials commonly used for their containment.

Thus, the preferred reactor for the reduction of fluotitanate salts should provide: (1) a reactor enclosure that is nonreactive with the titanium and byproducts, (2) a reaction volume with sufficient residence time to complete the reaction, (3) input of heat to maintain the reactants, titanium and other reaction products in the molten state, (4) mixing reactants and products to insure reactant availability for reaction and product homogeneity, and (5) a method to remove products and byproducts to make the process continuous.

U.S. Pat. No. 3,775,091 provides such an ideal reactor in an apparatus designed to melt refractory metals such as titanium, zirconium and their alloys in an induction heated, liquid cooled segmented copper crucible. The bottom of the crucible is formed by the cooled melt material and a continuous metal ingot of the desired material may produced and withdrawn. Calcium fluoride and the refractory metal are fed into the crucible where the calcium fluoride forms an insulating layer to protect the cooled copper. Water cooled copper coils around the crucible carry the alternating current for the induction heating.

SUMMARY OF THE INVENTION

The limitations and complexities of the prior art processes are overcome by the instant invention's use of induction slag melting both for the reduction reactor to produce titanium or its alloys and the formation of a metallic titanium ingot.

The process of this invention for making titanium metal includes the steps of recovering the titanium compounds from a titanium ore and reducing the titanium compounds to titanium metal. The process starts with a titanium ore, such as ilmenite, containing, for example, about 29% titanium and about 35.3% iron. The ore is fluorinated to produce a fluotitanate material. The fluorination agent may be an alkaline earth fluoride salt such as calcium fluosilicate or may be an aqueous hydrofluoric acid solution. If calcium fluosilicate is used the reactions are believed to proceed according to the following equations:

$$TiO_2 + CaSiF_6 \rightarrow CaTiF_6 + SiO_2$$

$$2FeO + CaSiF_6 \rightarrow CaFe_2F_6 + SiO_2$$

The contacting is carried out at a temperature determined by the fusion temperature of the salt. This roasted ore mixture is then leached at about 50° to 95° C. with water or an aqueous hydrofluoric acid solution. The leach solution is treated to precipitate iron while the alkaline earth fluotitanate stays in the hot leach solution. After solid-liquid separation, the liquor is concentrated by evaporation, and cooled to precipitate an alkaline earth fluotitanate solid material which is separated from the other liquor.

If an aqueous hydrofluoric acid solution is used the titanium oxide ore is contacted with an aqueous hydrofluoric acid solution at room temperature and then the spent ore residue filtered out of the slurry. The resulting titanium fluoride compound in the filtrate liquid is converted to an alkaline earth fluotitanate by the addition of an alkaline earth compound such as calcium fluoride or calcium carbonate at about 50° to 100° C. The hot filtrate liquid is then filtered to remove any excess alkaline earth compound and insoluble iron compounds. The filtered liquid is then concentrated by evaporation and cooled to precipitate and recover the alkaline earth fluotitanate.

This alkaline earth fluotitanate material is washed, further purified by dissolution and/or recrystallization and/or other methods, and then dried. The alkaline earth fluotitanate, such as $CaTiF_6$ is then fed under inert atmosphere into a molten mixing ball or reaction volume (9) (FIGS. 2 and 3) of induction slag melting equipment (11), along with an alkaline earth reductant, such as solid calcium for reduction according to the following equation:

$$CaTiF_6 + 2Ca \rightarrow Ti + 3CaF_2$$

Titanium metal is produced while the byproduct $CaF_2$ acts as a protective layer for the copper crucible during the induction melt operation. Alloy elements such as aluminum and vanadium can be added during this reduction/melting step. $CaF_2$ is removed physically from the titanium ingot and can be partially recycled by reaction according to the following equation:

$$CaF_2 + H_2SiF_6 \rightarrow CaSiF_6 + HF$$

for use in a fluorinating step.

DETAILED DESCRIPTION OF THE INVENTION

Figure 1:
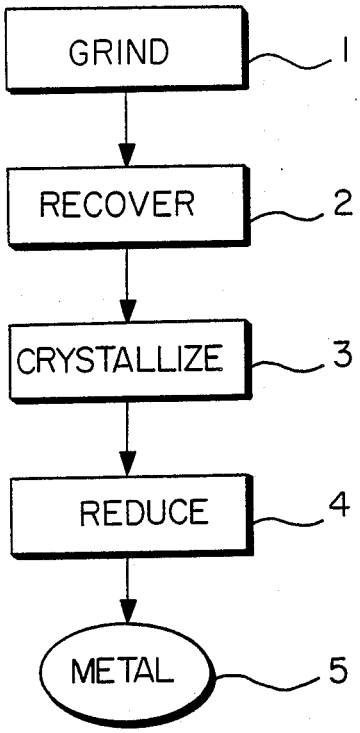
FIG. 1 shows a flow chart of the invention.

The invention will now be described in detail with reference to FIG. 1. A readily available, titanium ore containing $TiO_2$, such as ilmenite, is ground (1) to expose surface area and contacted with a fluorinating agent such as an alkaline earth fluoride salt, for example $CaSiF_6$ or aqueous hydrofluoric acid. In this connection $CaF_2$ can also be used, but its high melting point i.e. in excess of 1423° C. would entail higher equipment costs and higher operating costs. Using an alkaline earth fluoride salt the contacted ore is then roasted at at least the fusion or melting point of the alkaline earth fluoride salt. In this step, (2) the titanium values are converted to alkaline earth fluotitanate.

After cooling the roasted material, it is leached with an aqueous hydrofluoric acid. Preferably the material is ground or reduced in size again prior to leaching to increase the surface area of the material exposed to the aqueous hydrofluoric acid. This acidic leach is done under oxidizing conditions such as exposure to air. The oxidation converts ferrous fluoride compounds to the less soluble ferric fluoride compounds.

The insoluble ferric material, and other insoluble reactants and ore residue are then filtered off from the excess acidic leach containing the soluble alkaline earth fluotitanate.

If the fluorinating agent used is aqueous hydrofluoric acid then the titanium ore such as ilmenite, is ground, and then mixed with hydrofluoric acid, in aqueous solution. The slurry is then stirred at about 40° to 100° C.

The hot slurry is filtered to remove the spent ore residue and produce a liquor which is mixed with an alkaline earth compound, such as calcium fluoride or calcium carbonate. The mixture is heated to between about 60° to 100° C., to produce an alkaline earth fluotitanate. The mixture is then filtered hot to remove any excess alkaline earth compounds and insoluble materials such as iron compounds and to produce an alkaline earth fluotitanate solution (2).

Further purification of the alkaline earth fluotitanate solution is normally necessary to remove deleterious iron and other impurities. Purification techniques, such as treatment of the solution with solvent extractants or increasing the pH from less than pH 1 to pH 3 with base materials such as ammonia gas or calcium carbonate, are used and known to those skilled in the art.

After purification the alkaline earth fluotitanate is crystallized (3) from solution. If sufficient alkaline earth compounds to form the alkaline earth fluotitanate have not been added during prior process steps then these alkaline earth compounds, such as calcium carbonate, calcium fluoride or calcium hydroxide, are added at this time.

In order to crystallize and recover the alkaline earth fluotitanate, the aqueous solution must be brought to saturation, by evaporation of excess water. At this point, continued evaporation or equivalent means is used to precipitate the alkaline earth fluotitanate from solution. Other options, such as a common ion effect, can also be used effectively.

Washing the crystals (Steps 6), followed by dissolution and recrystallization further purifies the material. After final washing, the alkaline earth fluotitanate crystals are dried at a temperature to remove all water from the material but not at or exceeding a temperature that would decompose the fluotitanate compound.

Figure 2:
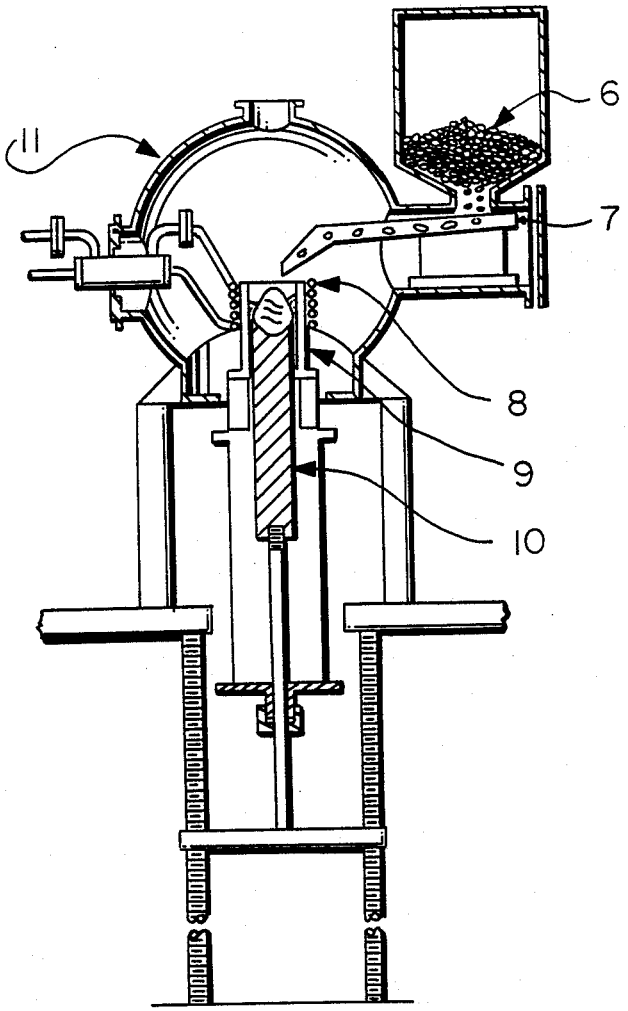
FIG. 2 shows apparatus for carrying out the invention.
Figure 3:
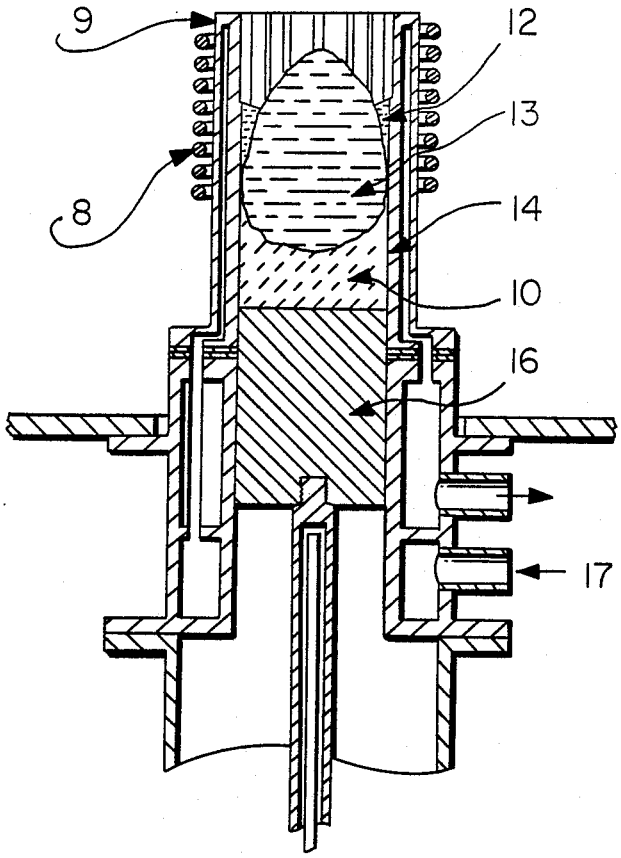
FIG. 3 shows induction slag melting equipment for carrying out the invention.

The first alkaline earth fluotitanate, alloying elements, and a second alkaline earth reductant such as calcium are mixed and fed as a solid flowing mixture (6) into the molten mixing zone (13) of an induction slag melting furnace crucible (9) under an inert gas, preferably argon, as it is cheaper and has a lower heat conductivity than helium (FIGS. 2 & 3). The reduction of the first alkaline earth fluotitanate by the second alkaline earth reductant produces titanium metal or titanium alloy of any desired composition with a combination of first and second alkaline earth fluorides as byproducts. The use of the same alkaline earth throughout the process i.e. as in the roast and the melt/reduction steps is simplest and allows the easiest recycle of byproduct material.

$CaF_2$ is the preferred flux material for operation of the induction slag melting furnace. Other alkaline earth halide fluxes can also be used, but these materials would have to have boiling points greater than the melting point of titanium or titanium alloys in order for the furnace to operate at, or less than the atmospheric pressure of the inert gas.

For example, $MgF_2$ is another flux which can be used but Mg boils at a lower temperature than Ca, thus making it more difficult to feed into the reaction volume and more likely to be vaporized off before complete reaction. In addition, $MgSiF_6$ is highly soluble in water, thus causing problems in the recycle of the flux material.

Since current induction slag furnace operation in titanium production does not incorporate and make the reduction step integral, but instead merely melts the titanium and other metal chips with $CaF_2$ as flux, it is apparent that the inductively coupled molten volume (13) of titanium or titanium alloy of this invention serves as a reactor and mixer to reduce the alkaline earth fluotitanates to titanium and to form a titanium or titanium alloy ingot (10). Alloy elements such as, but not limited to, aluminum and vanadium, can also be added during the melting step to form titanium alloys of any desired composition.

The titanium metal comes out of the induction furnace (11) as an ingot (10) coated in a layer of alkaline earth fluoride (14), such as $CaF_2$. $CaF_2$ is then readily chipped off from the ingot exterior and separated from the ingot (10).

Part of the alkaline earth fluoride, such as $CaF_2$, may be recycled to be reacted with hydrofluosilicic acid ($H_2SiF_6$), a fertilizer manufacture byproduct, to form for example $CaSiF_6$ and HF, which can be used in the fusion roast and leach steps respectively.

The examples hereinafter set forth will delineate with specificity the reaction process and conditions for producing the titanium materials according to the invention, along with FIGS. 1 to 3.

EXAMPLE 1

32.4 grams of ground rock ilmenite ore having a particle size as shown in table 1 and containing 27.9 weight percent titanium, 34.7 weight percent iron, and 0.2 weight percent carbon was mixed with 78.7 millimeters of 52 weight percent hydrofluoric acid and 28.1 milliliters of distilled water. The slurry was stirred at 90° C. until no liquid remained. 145 milliliters of distilled water was added, and the slurry stirred and heated at 90° C. for 2 hours, and 20.2 grams of wet residue was centrifuged out leaving 139 milliliters of light brown clear liquor. This liquor was mixed with 28.1 grams of calcium fluoride and stirred at 90° C. for 24 hours. The mixed liquor was then filtered, resulting in 138 milliliters of light brown, clear liquid and a residue waste. The filtered liquid was boiled down to 50 volume percent of the original volume, cooled on ice precipitating $CaTiF_6$ which was filtered from the boiled liquid. The precipitate was dried at 85° C. for 72 hours and represented a theoretical yield of 59 percent.

TABLE 1

| U.S. Sieve mesh | weight percent | |
|---|---|---|
| | Fraction | Cummulative |
| +70 | 0.00 | 0.00 |
| +100 | .2 | .2 |
| +140 | 1.7 | 1.9 |
| +200 | 5.1 | 7.0 |
| +270 | 10.6 | 17.6 |
| Pan | 82.4 | 100.0 |

EXAMPLE 2

100 milliliters of hydrofluoric acid leach liquor, obtained by leaching (contacting) ground rock ilmenite ore with aqueous hydrofluoric acid contained 27.7 grams per liter titanium and 24.9 grams per liter iron and had a pH of less than pH 1. Ammonia gas was bubbled through the liquid until pH 3 was reached. The liquid was then filtered producing 8.9 grams of wet residue and 110 milliliters of purified filtrate plus residue wash. The wet residue was dried overnight yielding 6.0 grams, was analyzed, and represented 95% removal of iron as solid $(NH_4)_3FeF_6$ from the liquid and a 1.4 percent loss of titanium from the liquor.

EXAMPLE 3

A preliminary test was performed to investigate the feasibility of having excess alkaline earth metal fluoride present during the reaction/melting operation of the invention. In this example, a 2-inch ID copper crucible (9) was used. 2250 grams of calcium fluoride and 400 grams of titanium metal chips were mixed and fed by a vibratory feeder (7) into a 2-inch ID crucible (9) inductively heated by a coil (8) and all contained by an external vessel (11). The titanium melted satisfactorily with the calcium fluoride forming the normal crust (14) around the exterior of the ingot (10). This example indicates the feasibility of operating at 83 weight percent calcium fluoride and 17 weight percent titanium as opposed to the normal operating feed of 2–20 weight percent and 98–80 weight percent, respectively, used in the normal induction slag melting of titanium as set forth by U.S. Pat. No. 3,775,091. This high calcium fluoride-to-titanium ratio is identical to the ratio formed during the reduction of calcium fluotitanate with calcium as intended by the invention.

EXAMPLE 4

292 grams of calcium fluotitanate were fed with approximately 116 grams of calcium into a 4-inch ID 24 segment copper crucible (9) within an external vessel (11). The induction coil (8) was powered by a 100 kW and 10,000 Hz power source. The mixture (6) of calcium fluotitanate and calcium was fed from the top side by a vibratory feeder (7). A 5250 gram titanium stub (16) was used, along with 150 grams calcium fluoride to begin the test and obtain a molten mass prior to feeding the reactants. The external vessel (11), which contained vibratory feeder (7), copper crucible (9), and the induction coil (8) was evacuated to 25 micrometers of Hg, and then backfilled to 3 psia with argon. A power setting for the induction coil (8) starting at 30-kW and slowly increased to 70 kW was used to first coat the crucible (9) with molten calcium fluoride slag (12), and then bring the molten mass (13) up to temperature. Upon forming the molten reaction mass (13), the power was adjusted to maintain approximately 70 kW and 25 degrees lead on the power factor. Feeding the calcium fluotitanate and calcium took approximately 25 minutes, during which, after a charge of reactants had been made, the reaction was allowed to go to completion prior to feeding more reactants. The ingot stub (10), after removal of the byproduct calcium fluoride, weighed 5283 grams, thus 33 grams of titanium was produced and represented a yield of 48 percent. This preliminary and simple test indicates the utility of the invention.

What is claimed is:

1. A continuous process for the recovery of titanium from a titanium ore comprising:

(a) contacting said ore with a fluorinating agent selected from the group consisting of alkaline earth metal fluorides and alkaline earth metal fluosilicates to form a fluotitanate, and (b) reducing the said fluotitanate with an alkaline earth metal under molten conditions, to produce said titanium.

2. The process of claim 1 wherein said alkaline earth metal is selected from the group consisting of calcium and magnesium.

3. The process of claim 2 wherein said contacting of said ore with said alkaline earth metal fluoride is under molten conditions.

4. The process of claim 1 additionally comprising conducting step (b) in an inductively heated reaction vessel.

5. The process of claim 1 wherein said fluotitanate is reduced by contacting with an alkaline earth metal at conditions sufficient to yield on immiscible molten mixture of the titanium and alkaline earth metal fluoride.

6. The process of claim 5 wherein said alkaline earth metal is selected from the group consisting of calcium and magnesium.

7. The process of claim 5 wherein said alkaline earth metal fluoride comprises calcium fluoride.

8. The process of claim 4 wherein titanium alloy material is produced by the addition of alloy elements to the inductively heated reaction vessel.

9. The process of claim 4 wherein there is formed an alkaline earth metal fluoride by-product in said reaction vessel, further comprising:

removing said alkaline earth metal fluoride from said reaction vessel;

reacting said alkaline earth metal fluoride with hydrofluorosilic acid to obtain a fluorinating agent product; and contacting said fluorinating agent product with said titanium ore.

10. A continuous process for the recovery of titanium metal from a titanium ore, comprising;

(a) contacting said titanium ore with an aqueous hydrofluoric acid solution to form a titanium fluoride compound;

(b) reacting said titanium fluoride compound with an alkaline earth metal compound to produce an alkaline earth metal fluotitanate; and (c) reducing said alkaline earth fluotitanate with an alkaline earth metal under molten conditions to produce titanium metal.

11. The process of claim 10 wherein in step (a) is carried out at room temperature and wherein step (b) is carried out at a temperature in the range of 50°–100° C.

* * * * *